US005277406A

United States Patent [19]

Knight

[11] Patent Number: 5,277,406

[45] Date of Patent: Jan. 11, 1994

[54] HYDRAULIC TENSION REGULATING DEVICE FOR ELONGATE TENSION BEARING MEMBER

[75] Inventor: Derek I. Knight, Gosford, Australia

[73] Assignee: The Secretary of State for Defence in Her Britannic Majesty's Government of the United Kingdom of Great Britain and Northern Ireland, London, England

[21] Appl. No.: 873,946

[22] Filed: Apr. 27, 1992

[30] Foreign Application Priority Data

Jun. 26, 1990 [GB] United Kingdom ..... 9014157

[51] Int. Cl.[5] ..... B63B 21/00; B66D 1/50

[52] U.S. Cl. ..... 254/228; 254/264; 114/213; 114/214

[58] Field of Search ..... 254/228, 264; 114/213, 114/214, 215-217

[56] References Cited

U.S. PATENT DOCUMENTS 3,519,246 7/1970 Belding ..... 254/264
4,072,122 2/1978 Balston ..... 114/217 X
4,615,509 10/1986 Biass ..... 254/264
4,641,816 2/1987 Kishida et al. ..... 254/228

FOREIGN PATENT DOCUMENTS 657758 9/1951 United Kingdom .
1481447 7/1977 United Kingdom .
1569958 6/1980 United Kingdom .

*Primary Examiner*—Andrew M. Falik
*Attorney, Agent, or Firm*—Nixon & Vanderhye

[57] ABSTRACT

A device for limiting the tension in a rope or the like comprises an anchorage plate (8) and a gripping unit (10) containing two piston and cylinder units (34), two gripping members (14) and a hydraulic control circuit which controls the gripping of the rope or the like in a manner dependent on the tension in the rope or the like. Tension P causes the gripping unit (10) and the anchorage plate (8) to separate, thus compressing fluid in chambers (46). This results in the double acting rams (30) biasing the gripping members (14) towards each other under the action of cams (26). If the tension rises above a threshold value the pressurized fluid trips pressure sensitive valve (54) allowing pressurized fluid to reverse reversing valve (55) thus temporarily relaxing the grip on the rope or the like.

17 Claims, 3 Drawing Sheets

HYDRAULIC TENSION REGULATING DEVICE FOR ELONGATE TENSION BEARING MEMBER

This is a continuation of PCT application No. PCT/GB91/00961, filed Jun. 14, 1991.

BACKGROUND OF THE INVENTION

1. Field of the Invention

The present invention relates to securing devices adapted to limit the tension in a rope or the like such that the tension remains below a predetermined maximum value.

2. Discussion of Prior Art

The term rope or the like which is used throughout the specification is intended to include metal and fibre stranded rope, unstranded flexible rope substitutes and chains.

When ropes or the like are used to moor a vessel to a land-based ground anchor, frequent adjustment of the moorings is often necessary to take account of rising and falling tides. If the vessel is securely moored at high tide, then as the tide falls the situation may be reached in which the moorings effectively support the vessel resulting in possible failure of either the rope or the like or the anchor. If the vessel is a section of a floating bridge, a similar situation may occur when a large load passes over the bridge. The consequent lowering of the vessel in the water may result in failure of the mooring or anchor. Both of the above problems are increased if the moorings have a significant vertical component. This situation frequently arises when there is a requirement to bridge a river having steep banks with a floating bridge.

The complete release of a rope or the like in a situation in which overload is imminent is clearly undesirable and a limited release of the rope or the like in order to reduce its tension to a safe level is clearly preferable.

The problems of securing a rope or the like in such a manner that its tension is limited to a predetermined maximum value have been addressed in a number of ways in the past.

One method of partially mitigating the above problems is to install a spring at some point in the mooring. There are a number of disadvantages associated with this solution: (a) such springs are very costly; (b) the maximum possible extension of the mooring is severely limited by the necessity for the spring to be easily handled; and (c) the tension maintained in the mooring will increase as the energy stored in the spring is increased.

A hydraulic chain tensioning device is disclosed in patent specification GB 1065641. In this device a tensioned chain is connected to a piston which urges fluid from a cylinder past a pressure relief valve. Such a device can maintain a constant tension in the chain but still only provides an extension limited by the stroke of the piston and cylinder device.

In order to overcome the limited extension problem of the GB 1065641 device GB 2097040 proposes a chain tensioning device for hauling mining machinery. The device incorporates a hydraulic motor and a hydraulic pump connected by circuitry incorporating a chain tension sensor. The device itself does not limit the length by which the chain can be extended however the complexity and consequential size means that the device is not easily portable.

An anchoring device is disclosed in Russian patent 1065286 in which a rope is gripped between two rollers.

Each roller has at its lower end an eccentric mounting for opposite ends of a hydraulic piston and cylinder. Rotation of the rollers causes reciprocatory movement in the piston and cylinder causing fluid to flow from one end of the cylinder to the other through a pressure relief valve. A major disadvantage of this device is that the rope being anchored needs to be of a precise size to be gripped successfully. If the rollers or rope become worn inadequate gripping of the rope will take place, and a rope slightly larger than the gap between the rollers will not be insertable between the rollers.

Summary of the Invention

The object of the invention is to provide a tension regulating device adapted to partially release a rope or the like when its tension reaches a threshold level thus partially relieving tension in the rope or the like and to regrip the rope or the like when its tension falls below the threshold value. Further objects of the invention include the provision of a tension regulating device which is easily portable, does not limit the extent to which the rope or the like can be paid out and can be used to grip ropes or the like of various sizes.

Thus according to the invention there is provided a tension regulating device for a rope or the like as hereinbefore defined comprising an anchorage and a gripping unit connected to the anchorage; the gripping unit having gripping surfaces for gripping a rope or the like locatable between the surfaces, means for detecting a force existing between the anchorage and the gripping unit and gripping surface control means operatively connected to the detecting means for urging the gripping surfaces towards each other when the detected force between the anchorage and the gripping unit is below a threshold force value.

A device constructed according to the invention may be constructed to meet the requirements set out above and in particular does not limit the extent to which the rope or the like may be paid out.

The detecting means preferably generates a force signal the magnitude of which is dependent on the magnitude of the force between the anchorage and the gripping unit. Such a signal can be conveniently processed by the control means to effect pressure on the gripping surfaces.

The control means preferably comprises a bistable device such as a pressure sensitive valve which is changeable from a first stable state to a second stable state when the threshold force is reached. Conveniently, the bistable device is activated when it receives a threshold force signal corresponding to the threshold force from the force detecting means.

In order to control the urging of the gripping surfaces, a reversing device which is capable of reversing or removing the pressure acting on the gripping surfaces is preferably provided. Conveniently the reversing device, which may be a reversing valve, is activated when the bistable device changes its state.

The gripping surface control means may comprise a hydraulic circuit, in which case the means for detecting the force between the anchorage and the gripping unit preferably comprises at least one piston and cylinder unit connected between the anchorage and the gripping unit so that a force between them pressurizes fluid in at least one piston and cylinder unit. A pump may be provided to recirculate fluid between the ends of the piston and cylinder unit in order that the device can be reset.

When the gripping surface control means comprises a hydraulic circuit, the circuit preferably includes an accumulator, to accommodate the effects of the difference in working cross sectional area of opposite ends of at least one piston and cylinder unit. This difference is accounted for by the cross sectional area of the unit's piston rod.

The gripping surface control means preferably comprises at least one double acting ram so that the urging together of the gripping surfaces and release in an overload situation can be conveniently achieved by providing a reversing valve in fluid supply lines leading to either end of the ram.

The gripping surface control means preferably further comprises camming means in order that secure gripping can be achieved by a small activation of the gripping surface control means.

The gripping unit preferably further comprises resilient supplementary urging means for urging the gripping surfaces towards each other. This results in the gripping surfaces always lightly gripping a rope or the like passing between them even if tension on the rope or the like is zero. Without these supplementary urging means there is a danger that the gripping unit would not grip the rope or the like as its tension rose from zero.

BRIEF DESCRIPTION OF THE DRAWINGS

The invention will now be described by way of example only with reference to the following drawings in which:

FIG. 2 shows the device's control circuitry as it would be when the device is gripping a rope or the like.

BRIEF DESCRIPTION OF PREFERRED EMBODIMENTS

Figure 1:
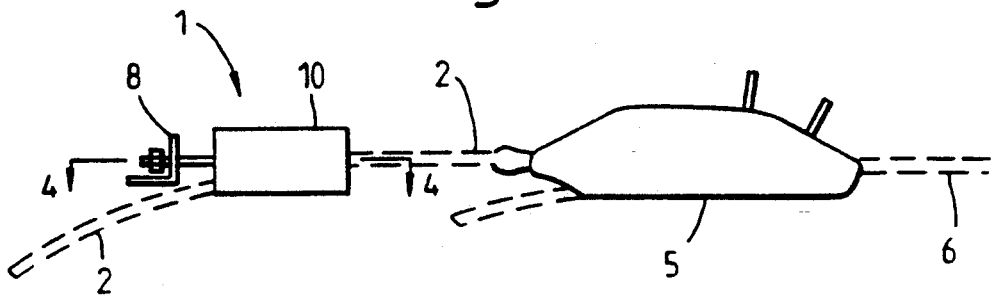
FIG. 1 shows a device according to the invention connected to a cable jack in use.

FIG. 1 shows a tension regulating device 1 gripping a first elongate tension bearing member, i.e. rope 2 which is used to restrain a cable jack 5. The cable jack is used to retain a second rope 6. The tension regulating device 1 comprises an anchorage plate 8 and a gripping unit 10. In use the anchorage plate is connected firmly to an anchor, and a second rope 6 is tensioned as required by the cable jack. If the tension in the second rope 6 rises above a predetermined tension threshold the tension in the first rope 2 rises accordingly and the gripping unit 10 releases the first rope 2 until the tension in the first and second ropes falls below the threshold value at which point the gripping unit regrips the first rope. In this way the load placed on any of the items shown in FIG. 1 or the anchorage to which the anchorage plate 8 is connected can be controlled.

The construction of the main components of the device will now be described in greater detail with reference to FIGS. 4 and 5.

Figure 4:
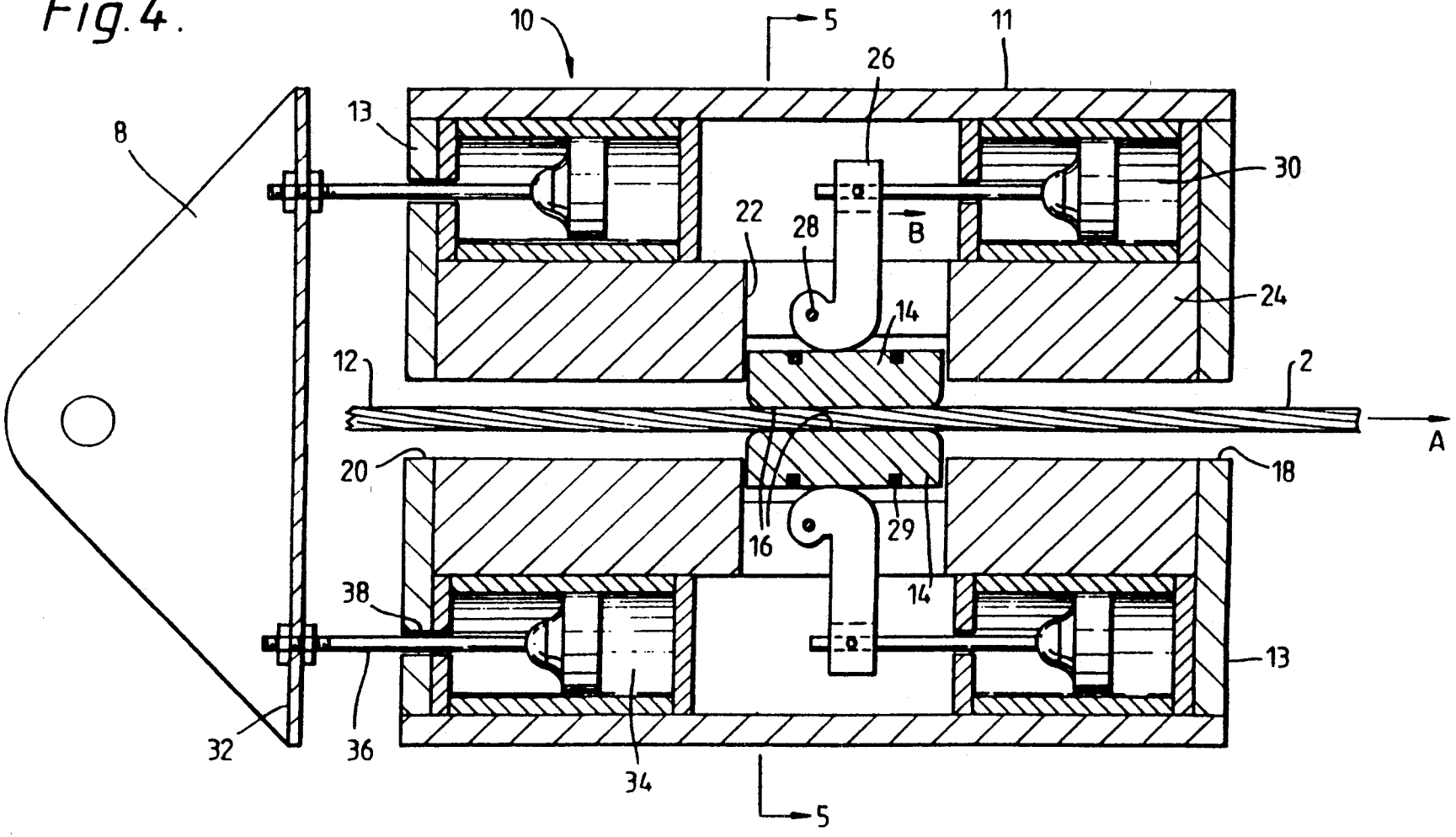
FIG. 4 is a section on the line 4—4 through the device according to the invention shown in FIG. 1 with the hydraulic connections and valves omitted for clarity.

FIG. 4 shows a tension regulating device according to the invention comprising an anchorage plate 8 and a gripping unit 10 having a casing 11. The device is shown gripping a rope 2, which is tensioned in the direction of the arrow A, and has an untensioned free end 12. The rope is gripped between two gripping members 14 each of which has a gripping surface 16. The gripping members 14 are positioned so that they can grip a rope extending through the gripper unit via holes 18 and 20 in the end faces 13 of the casing 11. Two gripper support members 24 extend from one end of the gripping unit to the other and are connected to the end faces 13. Each gripper support member 24 retains a gripping member 14 in a slot 22 so that it can be displaced inwardly towards a rope extending through the gripping device. A cam 26 is pivotably connected to each gripper support member 24 by a pivot 28, such that rotation of the cam about the pivot in the direction indicated by the arrow B urges the gripping surfaces 16 towards the rope. Each cam is actuated by a double acting ram 30.

Elastomeric members 29 pass round the gripping members 14 in order that the gripping members lightly grip the rope even in the absence of any camming action.

At the end of the gripper unit 10 adjacent to the anchorage plate 8 two double acting piston and cylinder units 34 are provided. The piston rods 36 of the double acting piston and cylinder units project through holes 38 in one end face 13 of the gripping unit. The piston rods 36 are rigidly connected to a flange 32 on the anchorage plate 8.

Figure 5:
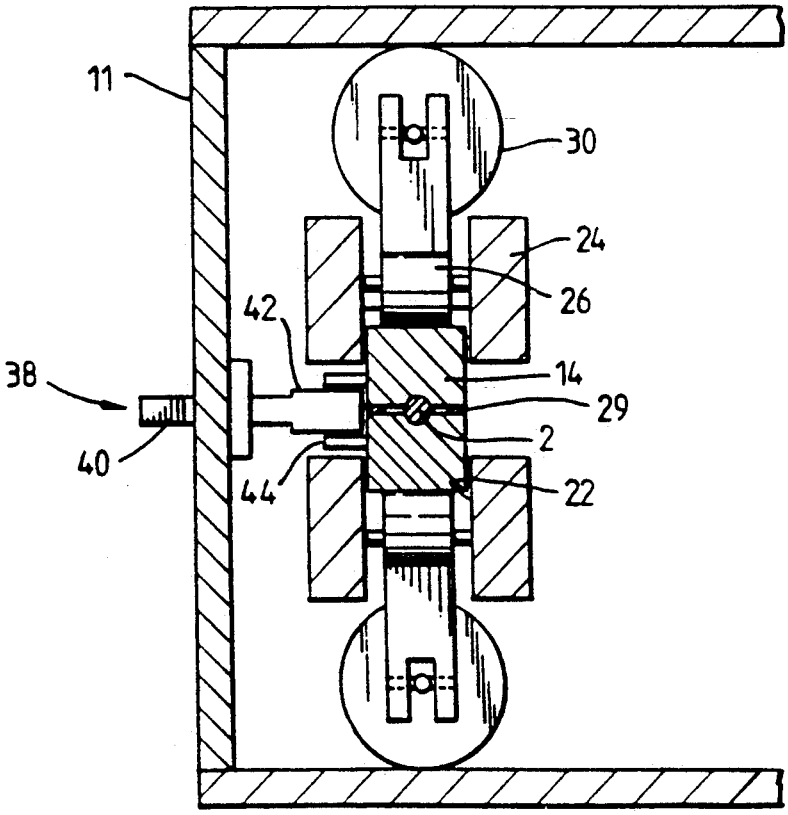
FIG. 5 is a section on the line 5—5 in FIG. 4.

FIG. 5 shows a cross section on the line 5—5 in FIG. 4 and like parts are shown by like numerals. FIG. 5 also shows a gripping member separating device 38, which is used to separate the gripping members 14 in order to facilitate insertion of a rope 2 into the device. The separating device 38 comprises a square ended shaft 40 journalled in a side face of the casing 11. An inner end of the shaft is provided with a camming surface 42 which bears against projections 44 of the gripping members 14. Rotation of the shaft 40 by means of its square end separates the gripping members 14 against the force of the elastomeric members 29.

The construction and operation of the hydraulic circuit controlling movement of the gripping members will now be described with reference to FIGS. 2 and 3. These figures show only one piston and cylinder unit 34, and one double acting ram 30 for clarity.

Figure 2:
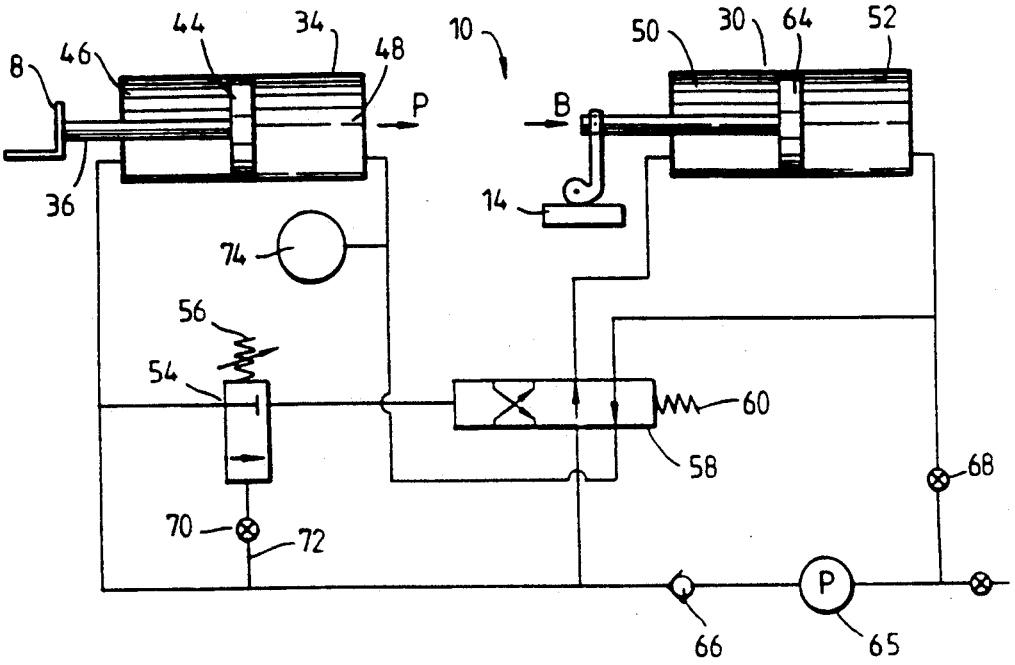

FIG. 2 shows the hydraulic circuit as it would be when the force P exerted on the gripping unit by the rope is less than a predetermined threshold force. Movement of the gripping unit 10 away from the anchorage plate 8 causes double acting piston 44 to compress fluid in chamber 46 of the double acting piston and cylinder unit 34. As long as the pressure developed in chamber 46 is insufficient to overcome the force of adjustable spring 56, the pressure sensitive valve 54 and the reversing valve 58 remains in the positions shown in FIG. 2. The pressurized fluid in chamber 46 communicates via a reversing valve 58 with first ram chamber 50. This pressurized fluid urges ram piston 64 to the right as viewed in FIG. 2, thus causing the cam 26 to be rotated such that the gripping members 14 (only one shown in FIG. 2) are urged towards each other thus gripping the rope.

Figure 3:
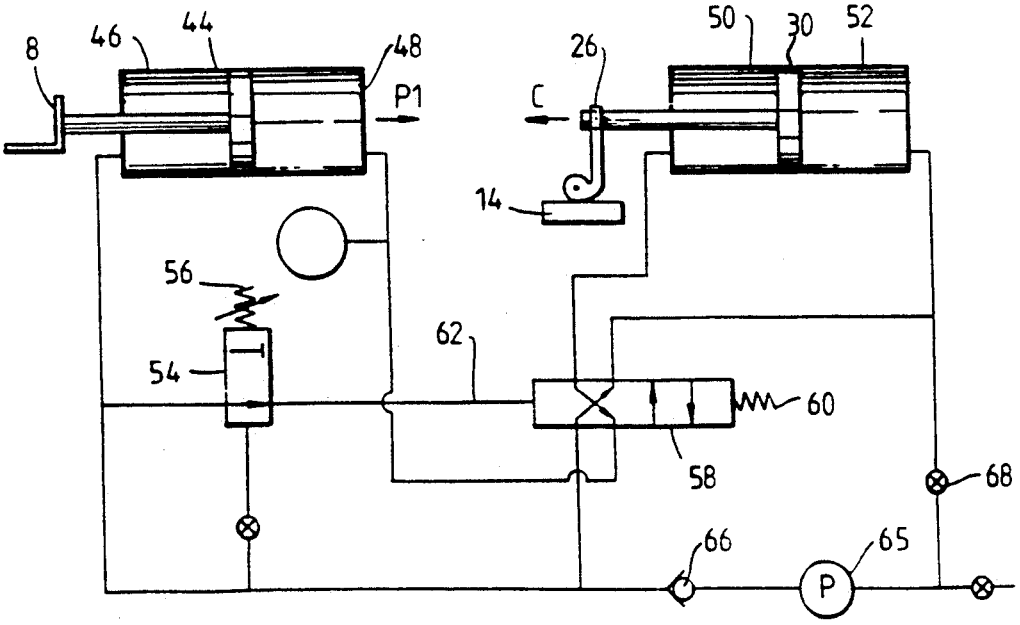
FIG. 3 shows the device's control circuitry in an overload release situation.

FIG. 3 shows the situation in which the load P has increased to a level P1 which is above the predetermined threshold level. This threshold level is determined by the setting of the adjustable spring 56 which controls movement of the pressure sensitive valve 54. In practice the first and second ropes 2 and 6 would be tensioned to the maximum permissible extent, the spring 56 adjusted until slippage through the gripping unit 10 just occurred, and finally the tension in the ropes adjusted as desired. When the pressure developed in chamber 46 is sufficient to overcome the force of the adjustable spring 56 the pressure sensitive valve 54 moves to the position shown in FIG. 3 and reversing line 62 is placed in communication with the pressurized fluid. Pressure in the reversing line 62 moves the reversing valve 58 against the force of a return spring 60 to the position shown in FIG. 3. This places second ram chamber 52 in communication with the pressurized fluid, which reverses the biasing of the double acting ram 30. The cam 26 is rotated in the direction of arrow C, thus releasing the gripping members. During this operation ram piston 64 moves so as to decrease the volume of the first ram chamber 50 and fluid passes via the reversing valve 58 to chamber 48 of the piston and cylinder unit 34.

As a result of the grip on the rope being relaxed the rope slips through the gripping unit 10. Consequently the force exerted on the gripping unit by the rope will be reduced and the valves 54 and 58 will return to the position shown in FIG. 2. If the slippage of the rope has allowed the rope's tension to fall sufficiently that the force P is below the threshold value then the gripping unit will continue to grip the rope. If the force P is above threshold value however the valves 54 and 58 will once again return to the position shown in FIG. 3 and further slippage will be permitted. This sequence will continue until the force P is less than the threshold value.

After repeated slipping sequences as described above the double acting piston 44 will effectively reduce the size of chamber 46 to zero. It will therefore periodically be necessary to return the double acting piston 44 rightwards (as seen in FIG. 2). This operation is performed with the valves in the position shown in FIG. 2. The valve 70 is closed, the valve 68 is opened and the hand pump 65 is operated to recirculate fluid from chamber 48 to chamber 46 of the double acting piston and cylinder unit 34. The one way valve 66 ensures that the rope remains gripped during this operation. The closing of valve 70 permits the above resetting to be carried out even if P is close to the critical threshold value. In such situations the operation of the pump 65 would reverse the pressure sensitive valve to the position shown in FIG. 3 if the valve 70 was not closed. This would result in the grip on the rope being relaxed. As an alternative to providing the valve 70 for closure while resetting the device the adjustable spring 56 may be adjusted to provide a maximised force biasing the pressure sensitive valve into the position shown in FIG. 2 in order to prevent accidental reversal of the reversing valve 58. The pump 65 will also be used for filling the circuit with fluid.

Due to the difference in the cross sectional working areas of chambers 46 and 48 accounted for by the area of the piston rod 36 an accumulator 74 is provided to accommodate excess fluid which becomes available as resetting of the device occurs.

Conventional bleed valves for releasing air from the circuit would also be included but are not shown for reasons of clarity.

I claim:

1. A tension regulating device for an elongate tension bearing member comprising an anchorage and a gripping unit connected to the anchorage; the gripping unit having:

gripping surfaces for gripping said tension bearing member locatable between the surfaces, means for detecting a force existing between the anchorage and the gripping unit; and gripping surface control means operatively connected to the detecting means for urging the gripping surfaces towards each other when the detected force between the anchorage and the gripping unit is below a threshold force value.

2. A device as claimed in claim 1 wherein the force detecting means produces a force signal the magnitude of which is dependent on the magnitude of said force.

3. A device as claimed in claim 1 wherein the gripping surface control means comprises a bistable device which is changeable from a first stable state to a second stable state when the threshold force is reached.

4. A device as claimed in claim 3 wherein the gripping surface control means comprises a reversing device which is reversible in order to reverse or remove said urging.

5. A device as claimed in claim 4 wherein said reversing device is responsive to said bistable device and, on receipt of a force signal corresponding to the threshold force, the bistable device changes its state and the reversing device reverses.

6. A device as claimed in claim 1 wherein the gripping surface control means comprises a fluid circuit.

7. A device as claimed in claim 6 wherein the force detecting means comprises one or more piston and cylinder units connected between the anchorage and the gripping unit so that the force between the anchorage and the gripping unit pressurizes fluid in the fluid circuit.

8. A device as claimed in claim 7 wherein the device includes a pump connected to pump fluid between opposite ends of the at least one piston and cylinder unit to reset the device.

9. A device as claimed in claim 7 comprising an accumulator in fluid communication with the at least one piston and cylinder unit.

10. A device as claimed in claim 6 wherein the gripping surface control means comprises a pressure sensitive valve which causes a fluid passage to open when the threshold force is reached.

11. A device as claimed in claim 6 wherein the gripping surface control means comprises a reversing valve for reversing fluid connections when the threshold force is reached.

12. A device as claimed in claim 10 wherein the opening of the fluid passage by the pressure sensitive valve causes reversing of the reversing valve.

13. A device as claimed in claim 1 wherein the gripping surface control means comprises at least one double acting ram.

14. A device as claimed in claim 1 wherein the gripping surface control means comprises camming means.

15. A device as claimed in claim 1 wherein the gripping unit further comprises supplementary urging means for urging the gripping surfaces towards each other.

16. A device as claimed in claim 15 wherein the supplementary urging means is resilient.

17. Tension regulating device for regulating tension in an elongate tension bearing member, said device comprising:

pressure generating means for generating a fluid pressure related to tension on said elongate tension bearing member;

fluid pressure operating means for gripping said elongate tension bearing member with a grip strength related to said tension when fluid pressure is applied in a forward direction and for reducing said grip strength when fluid pressure is conduit means, responsive to said fluid pressure, for applying fluid pressure to said operating means in a forward direction when said fluid pressure is below a predetermined limit and for applying fluid pressure to said operating means in said reverse direction when said fluid pressure is not less than said predetermined limit.

* * * * *